United States Patent [19]

Edwards

[11] Patent Number: 4,825,474

[45] Date of Patent: May 2, 1989

[54] COLD WEATHER MASK

[76] Inventor: Joseph H. Edwards, 3455 E. Tree Farm La., Salt Lake City, Utah 84121

[21] Appl. No.: 150,140

[22] Filed: Jan. 29, 1988

[51] Int. Cl.[4] ..... A41D 13/00

[52] U.S. Cl. ..... 2/206

[58] Field of Search ..... 2/206, 9, 202, 203, 2/204, 205, 174, 171; 128/139

[56] References Cited

U.S. PATENT DOCUMENTS

| | | | |
|---|---|---|---|
| 731,135 | 6/1903 | Scott | 2/206 |
| 3,943,575 | 3/1976 | Bolker | 2/205 |
| 4,095,290 | 6/1978 | O'Brien | 2/9 |
| 4,300,240 | 11/1981 | Edwards | 2/206 |
| 4,641,379 | 2/1987 | Martin | 2/206 X |

*Primary Examiner*—Peter Nerbun

*Attorney, Agent, or Firm*—Trask, Britt & Rossa

[57] ABSTRACT

A mask has a face member sized and shaped to fit about the face. It extends from an upper edge proximate the bridge of the nose and eye socket areas downward to the junction of the jaw with the neck area. The mask has ear sections which extend over the ears and three coacting Velcro sections spaced apart to fasten the mask at the back of the head of the user.

11 Claims, 2 Drawing Sheets

COLD WEATHER MASK

BACKGROUND OF THE INVENTION

1. Field

This invention relates to cold weather apparel. In particular, this invention provides for an improved cold weather mask particularly suitable for use by skiers, snow mobileers, and others exposed to cold weather.

2. State of the Art

A variety of protective face masks or cold weather masks have been devised. For example, U.S. Pat. No. 766,963 (Murray) shows a muffler. U.S. Pat. No. 731,135 (Scott) shows a type of neck and ear mechanism. U.S. Pat. Nos. 2,276,612 (Ellis); 2,573,537 (Bouffard) and 3,768,100 (Colman) all show other forms or type of neck and face protective wear.

More recently, U.S. Pat. No. 4,300,240 (Edwards) discloses a face mask made of a thin rubber cloth-type material. This mask is in use and is manufactured and sold by Edwards Ski Products, Inc. of Salt Lake City, Utah. Cold weather masks such as those disclosed by Edwards, even though suitable for use in a wide variety of applications, have been found to be deficient in some circumstances such as when other garments do not cover the ears or when other garments do not adequately protect the back of the head.

SUMMARY OF THE INVENTION

A face mask has a face member formed of a nylon laminate-type cloth. The face member is sized and shaped to fit snugly about the face. It extends in width over the cheeks to the left and right ear areas and in length from an upper edge to a lower edge. The upper edge extends over the bridge of the nose and approximately and contouredly along the lower part of the eye socket areas. The lower edge extends along and proximate the intersection of the neck with the underside of the jaw. The face member has first aperture means formed therein to register with the nostrils of the nose for the passage of air. Second aperture means is formed to register with the mouth also for the passage of air. A first seam extends from the first aperture proximate the nose to the chin area to join portions of the face member therealong.

A spacer which is in some cases triangular in shape extends from the chin area to the lower edge. A second and third seam each extend from the first seam to join the spacer to the face member along the sides of the spacer. The face mask also has securing means adapted to the face member for securing the face member to the face of the user. In a preferred embodiment, the mask may also have left and right ear sections which are each unitarily formed to extend from the face member rearwardly to substantially cover the left and right ears respectively. The ear sections may desirably have apertures formed therein for the passage of sound therethrough.

Securing means preferably includes a left and right securing section each unitarily formed respectively with the left and right ear sections to extend rearwardly and about the back of the head. The left and right securing sections each have fastening means at the distal ends thereof to fasten the left and right securing sections together to hold the face mask to the face of the user. Desirably, the left and right securing sections are each formed to have a length extending from an upper edge between the top of the ears and the user's head and a lower edge extending between the lower end of the ears behind the user's head at the base of the skull. The upper edge is sized longer than the lower edge with the securing sections angulating inward to substantially conform to the shape of the head. The securing sections desirably overlap and include a plurality of spaced apart coacting Velcro strips.

It is highly desired that the face mask be formed of a nylon laminate type material which has an exterior four-way stretchable nylon layer with an interior nylon stretch terry cloth layer.

BRIEF DESCRIPTION OF THE DRAWINGS

In the drawings which illustrate the best mode presently contemplated for carrying out the invention.

DESCRIPTION OF THE ILLUSTRATED EMBODIMENT

Figure 1:
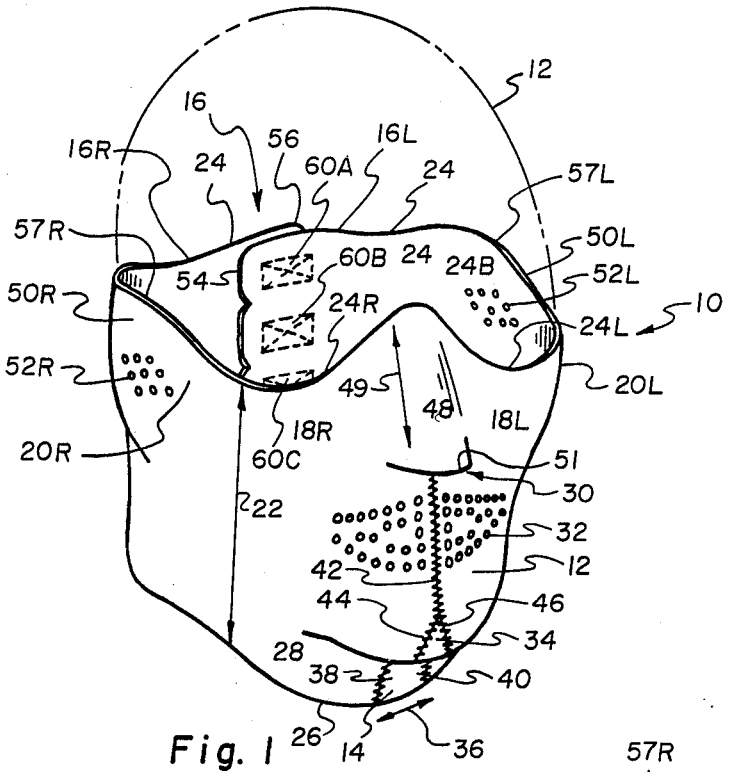
FIG. 1 is a perspective view of a mask of the instant invention.

A cold weather face mask, generally depicted by the number 10 appears in FIG. 1, is mounted to the head and face of a user which is shown in part in phantom 12. The mask 10 includes a face member 12, a spacer 14, and securing means 16.

The face member 12 is here formed of a nylon laminate-type cloth which is sized and shaped to fit snugly about the face. It extends in width over the cheeks 18L and 18R to the left 20L and right 20R ear areas. As here depicted, the ear area is that area proximate but forward of the ears of the user. It may be regarded as the area of the temples or upper jaw extending downward to the base of the jaw. The face member 12 also extends in length 22 from an upper edge 24 to a lower edge 26. As can be seen, the upper edge 24 extends over the bridge of the nose 24B and then proximate and contouredly along the lower part of the eye socket areas 24L and 24R.

Figure 2:
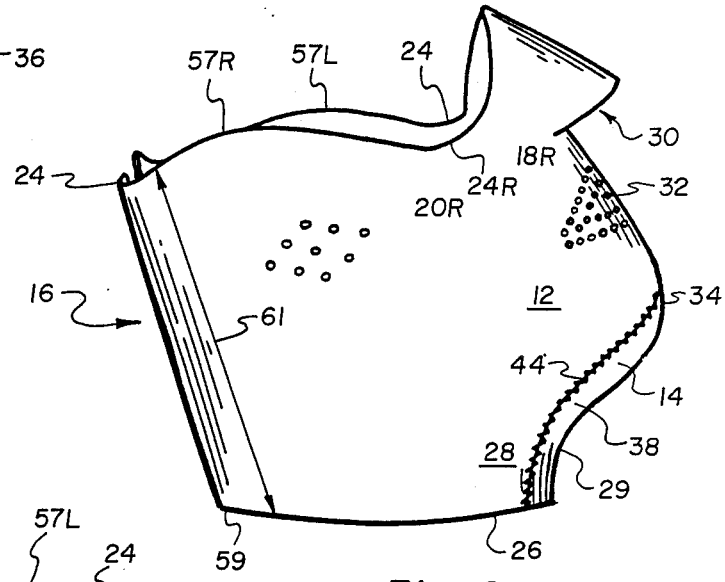
FIG. 2 is a right side view of a mask of the instant invention.
Figure 3:
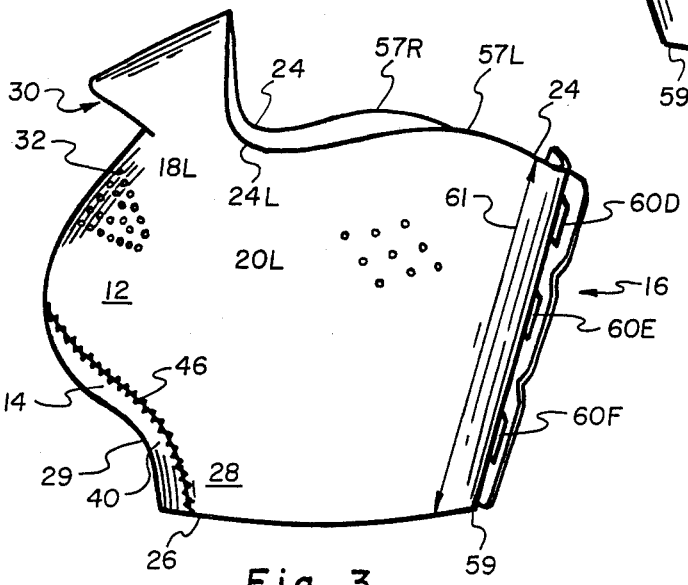
FIG. 3 is a left side view of a mask of the instant invention.

As better seen in FIGS. 2 and 3, the lower edge 26 extends along the approximate intersection of the neck of the user with the underside of the user's jaw generally in the vicinity as depicted in FIGS. 2 and 3 by the numeral 28. That is, the mask 10 illustrated in FIGS. 1 through 6 for purposes of illustration may appear to extend farther down the neck of the user than as above stated. This illustration is made simply to more clearly illustrate the curvature 29 in the area 28 rather than to definitively illustrate the actual juncture of the chin area with the neck. Indeed, one can place their finger underneath their chin and move it rearward until it comes in contact with the individual's neck. This may be best stated to be the intersection of the neck with the underside of the jaw.

Figure 4:
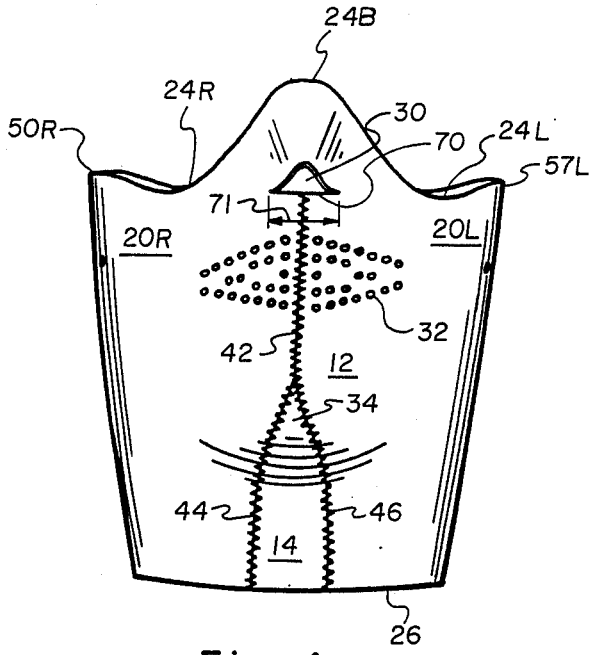
FIG. 4 is a front view of a mask of the instant invention.
Figure 5:
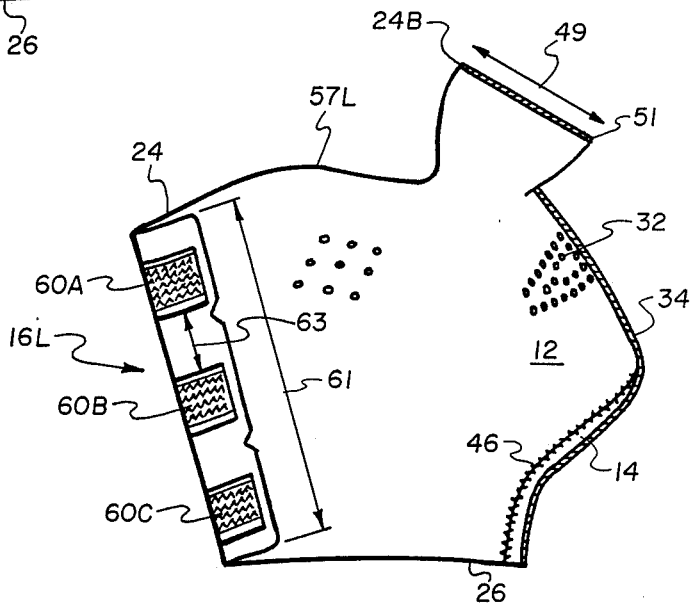
FIG. 5 is a left cross-section of a mask of the instant invention.
Figure 6:
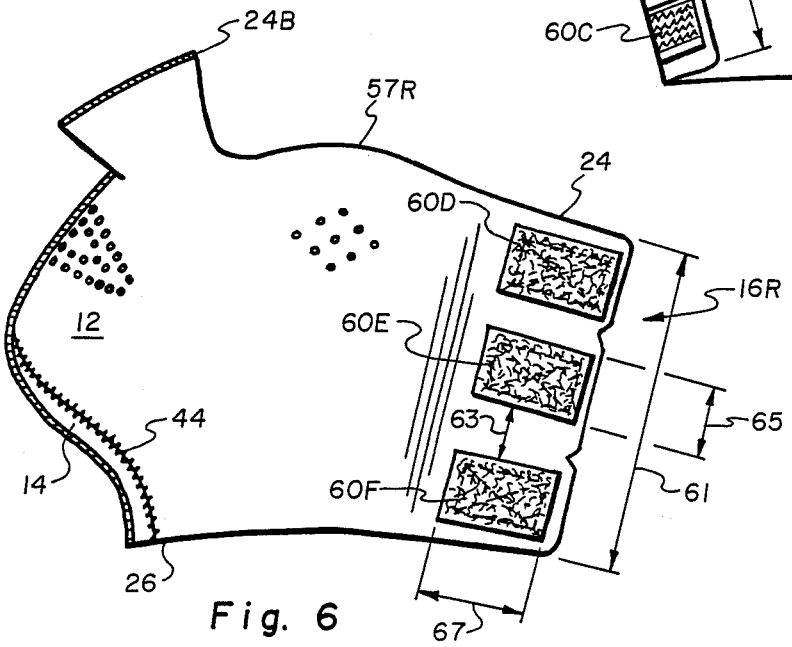
FIG. 6 is a right cross-section of a mask of the instant invention.

As can be further seen in FIGS. 1 and 4, the face member 12 has first aperture means 30 formed therein proximate the nostrils of the nose (not illustrated) for the passage of air therethrough. Second aperture means is also formed in the face member 12 to register with the mouth for passage of air therethrough. As best seen in FIG. 1, the second aperture means is here shown to be a plurality of small holes or apertures 32 stamped in a pattern to generally register with the mouth of a user for passage of air between the interior and the exterior of the face member 12.

As noted before, the mask 10 also includes a spacer 14. For ease in the manufacturing process and also to avoid unnecessary tension and stretching of the mask about the face of the user resulting in potential discomfort to the user, an insert 14 is positioned to extend from the chin area 34 to the lower edge 26. This spacer is desirably formed of the same material as the face member 12. The spacer 14 as here shown has a width 36 and extends between two sides 38 and 40.

As can be seen in FIG. 1, the face member 12 has first seam means 42 which extends from the vicinity of the first aperture 30 to the chin area 34. The first seam means 42 joins opposite left and right halves of the face member 12 and is here shown to be a stitched seam. Second and third seam means 44 and 46 each extend from the first seam means proximate the chin area 34 to the lower edge 26 to join the sides 38 and 40 of the spacer 14 to the face member 12 as shown in FIG. 1. The second and third seam means 44 and 46 are here shown to be stitched seams.

As can be seen the face member 12 is desirably unitarily formed with a nose piece 48 extending over and along the length 49 of the user's nose from the bridge area 24B to proximate the tip 51 thereof. In some circumstances, it may be desirable or preferred to have a fourth seam formed between the bridge 24B and the tip of the nose piece 48 and so that the face member 12 may be more easily formed and manufactured or for other reasons.

It may also be seen in FIG. 1 that it is desirable for the face member 12 to include a left 50L and right 50R ear sections which are unitarily formed with the face member 12 and extend rearwardly to substantially cover the left and right ears of the user respectively. Desirably, the left and right ear sections 50L and 50R each have apertures 52R and 52L to facilitate the passage of air and sound from interior to exterior the mask 10.

The securing means 16 here shown preferably includes a left 16L and right 16R securing section each unitarily formed respectively with the left and right ear sections 50L and 50R to extend rearwardly about the back of the head and desirably sized to overlap. The left 16L and right 16R securing sections each have fastening means associated therewith at the distal ends 54 and 56 to fasten the left 16L and right 16R securing sections together. The securing sections 16L, 16R extend from the upper edge 24 which is there positioned approximately at the middle of the back of the head generally on a level line extending from about the top of one ear behind the user's head to the other. It should be understood that the upper edge 24 may vary in form and in relative position for purposes of cost and fashion. However, the present preferred arrangement as shown in FIGS. 1–3 has a higher portion 57R and 57L proximate the ears with the upper edge 24 extending about the back of the head in what some might identify as the base of the skull and others might identify as the middle of the head.

The securing sections 16L and 16R extend to a lower edge 59 extending along the intersection of the neck with the head which is proximate the location of a shirt collar. The left 16L and right 16R securing sections are each desirably sized to overlap in order to provide for stability in securing and an adjustment range to accommodate to different users. Further, the fastening means associated with the securing means is preferably a plurality of spaced apart coacting velcro strips 60A, 60B, 60C, 60D, 60E and 60F. The velcro strips 60A to 60C are spaced to register with coacting strips 60D to 60F. The strips 60A–60F are spaced substantially evenly along the length 61 of the left 16L and right 16R securing sections. The use of three velcro strips each spaced 63 approximately from one-half to one and one-half inches apart is most preferred because it allows for flexibility of the mask as the user moves or articulates the head. Further, binding and snagging with the user's hair is minimized by the use of the spaced apart velcro strips as noted above which are most desirably approximately $\frac{3}{4}''$ in length 65 and one to two inches in width 67.

It may further be seen that the face mask 10 and in particular the face member 12 has an optional middle edge 70 which is sized in width 71 to extend the approximate width of the nose. The middle edge 70 is desirably positioned to be below the nose and above the upper lip. Desirably, the first seam means 42 extends toward the chin area 34 therefrom.

Figure 7:
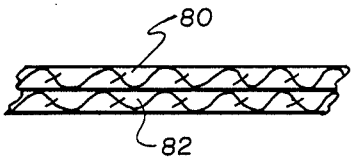
FIG. 7 is a partial enlarged cross-section of material of a mask of the instant invention.

As noted hereinbefore, the face mask 10 is preferably formed of a nylon laminate-type material. Referring specifically to FIG. 7 an enlarged small cross-section of material is shown to illustrate that the preferred material includes an exterior four-way stretchable nylon layer 80 and an interior nylon stretch terry cloth layer 82. The two layers 80 and 82 are formed into a single laminated material by conventional manufacturing processes. Other materials may be interspaced therebetween to, for example, improve the insulating characteristics of the mask 10. However, such materials should be elastically deformable or stretchable. The stretchable nylon terry cloth 82 is positioned to be in contact with the skin of the user for purposes of comfort. Nylon terry cloth has a soft, pleasing feel which in turn communicates to the user a feeling of warmth and at the same time minimizes friction upon movement of the jaw during speech or other facial movement. At the same time the four-way stretchable nylon 80 provides an excellent wind and temperature shield and in turn acts as an excellent insulator to provide warmth to the user.

To manufacture a mask 10 of the type illustrated in FIGS. 1 through 3 it may be appreciated that a mask member of the type illustrated in FIG. 1 may be formed by using an appropriate die to cut from a quantity of nylon laminate cloth. Similarly, the spacer may be formed. The same die or a separate die may be used to form the second aperture 32 while conventional sewing machines or industrial sewing machines may be used to form the first, second and third seams.

In use, the mask is snugly positioned about the face so that the upper edge 24 has a portion extending over the bridge of the nose 24B and along eye socket areas 24L and 24R over the ears extending generally rearward as illustrated in FIG. 1. The securing means 16 may be easily secured by positioning coacting velcro strips with respect to each other and pressing them together.

It is to be understood that the embodiments of the invention herein described are merely illustrative of the application of the principles of the invention. Reference herein to details of the illustrated embodiment is not intended to limit the scope of the claims which themselves recite those features regarded as essential to the invention.

I claim:

1. A face mask comprising:

a face member formed of a nylon-laminate type cloth which is sized and shaped to fit snugly about the face to extend in width over the cheeks to the left and right ear areas and in length from an upper edge to a lower edge, said upper edge extending over the bridge of the nose and proximately and contouredly along the lower part of the eye socket areas, said lower edge extending along the proximate intersection of the neck with the underside of the jaw, said face member having first aperture means formed therein positioned to proximately register with the nostrils of the nose for the passage of air therethrough, said face member having second aperture means formed therein to register with the mouth for passage of air and sound therethrough, said face member being formed to have first seam means extending from proximate said first aperture to proximate the chin area to join portions of the face member therealong;

a spacer formed of a nylon-laminate type cloth and sized and shaped in length to extend from proximate the first seam means over the chin area to the lower edge, to extend between two sides which are farther apart at the lower edge than proximate said first seam means and to extend in width an amount selected to proximate the width of the chin in the chin area;

second and third seam means each extending from proximate the first seam means past the chin area to the said lower edge to join said spacer to said face member along the side of said spacer; and securing means adapted to said face member for securing said face member to the face of a user.

2. A face mask comprising:

a face member formed of a nylon-laminate type cloth which is sized and shaped to fit snugly about the face to extend in width over the cheeks to the left and right ear areas and in length from an upper edge to a lower edge, said upper edge extending over the bridge of the nose and proximately and contouredly along the lower part of the eye socket areas, said lower edge extending along the proximate intersection of the neck with the underside of the jaw, said face member having first aperture means formed therein positioned to proximately register with the nostrils of the nose for the passage of air therethrough, said face member having second aperture means formed therein to register with the mouth for passage of air and sound therethrough, said face member being formed to have first seam means extending from proximate said first aperture to proximate the chin area to join portions of the face member therealong;

a spacer formed of a nylon-laminate type cloth and sized and shaped in length to extend from proximate the first seam means over the chin area to the lower edge, to extend between two sides which are farther apart at the lower edge than proximate said first seam means and to extend in width an amount selected to proximate the width of the chin in the chin area;

second and third seam means each extending from proximate the first seam means past the chin area to the said lower edge to join said spacer to said face member along the side of said spacer;

left and right ear section means each formed unitarily with said face member to extend rearwardly and to substantially cover the left and right ears respectively; and securing means adapted to said face member for securing said face member to the face of a user.

3. The face mask of claim 2 wherein said left and right ear section means each have aperture means formed therein for the passage of sound therethrough.

4. The face mask of claim 2 wherein said securing means includes a left and right securing section each unitarily formed respectively with said left and right ear sections to extend rearwardly and about the back of the head, said left and right securing sections each having fastening means associated therewith at the distal ends thereof to fasten said left and right securing sections together.

5. The face mask of claim 4 wherein the left and right securing sections are each formed to have a length extending from an upper edge extending between the top of the ears behind the user's head and a lower edge extending behind the user's head at the base of the skull, said upper edge being sized longer than said lower edge to angulate the said left and right securing sections inwardly to substantially conform to the shape of the head.

6. The face mask of claim 5 wherein said left and right securing means are sized to overlap, wherein said fastening means is a plurality of spaced apart coacting velcro strips positioned in spaced apart relationship along the length of said left and right securing means proximate the said distal ends.

7. The face mask of claim 5 wherein said face member has a middle edge as part of said first aperture means, said middle edge being positioned to be below the nose and above the upper lip, said first seam means extending therefrom.

8. The face mask of claim 6 wherein the fastening means is three coacting velcro strips substantially evenly spaced along the length of said left and right securing sections.

9. The face mask of claim 8 wherein said nylon-laminate type material has an exterior four-way stretchable nylon layer and an interior nylon stretch terry cloth layer.

10. A method of fabricating a face mask comprising:

supplying a nylon-laminate type cloth having an external layer of four-way stretchable nylon and an internal layer of stretchable nylon terry cloth;

supplying die means to form said nylon-laminate type cloth into a face member sized and shaped to fit snugly about the face to extend in width over the cheeks to the left and right ear areas and in length from an upper edge to a lower edge, said upper edge extending over the bridge of the nose and proximately and contouredly along the lower part of the eye socket areas, and said lower edge extending along the proximate intersection of the neck with the underside of the jaw, forming a first aperture means in said face member to proximately register with the nostrils of the nose for the passage of air therethrough;

forming a second aperture means in said face member to register with the mouth for passage of air and sound therethrough;

forming a first seam means in said face member to extend from proximate said first aperture to proximate the chin area to join portions of the face member therealong;

supplying a spacer formed of a nylon-laminate type cloth and sized and shaped in length to extend from proximate the said first seam means over the chin area to the lower edge, to extend between two sides which are farther apart at the lower edge than proximate said first seam means and to extend in width an amount selected to proximate the width of the chin in the chin area;

forming second and third seam means each extending from the first seam means proximate the chin area to the said lower edge to join said spacer to said face member along the side of said spacer; and supplying securing means and adapting same to said face member for securing said face member to the face of a user.

11. A face mask comprising:

a face member formed of a nylon-laminate type cloth which is sized and shaped to fit snugly about the face to extend in width over the cheeks to the left and right ear areas and in length from an upper edge to a lower edge, said upper edge extending over the bridge of the nose and proximately and contouredly along the lower part of the eye socket areas, said lower edge extending along the proximate intersection of the neck with the underside of the jaw, said face member having first aperture means formed therein positioned to proximately register with the nostrils of the nose for the passage of air therethrough, said face member having second aperture means formed therein to register with the mouth for passage of air and sound therethrough, said face member being formed to have first seam means extending from proximate said first aperture to proximate the chin area to join portions of the face member therealong;

a spacer formed of a nylon-laminate type cloth and sized and shaped in length to extend over the chin area to the lower edge and to extend between two sides in width an amount selected to proximate the width of the chin;

second and third seam means to join said spacer to said face member along the said two sides of said spacer;

left and right ear section means each formed unitarily with said face member to extend rearwardly and to substantially cover the left and right ears respectively; and securing means adapted to said face member for securing said face member to the face of a user, said securing means including a left and right securing section each unitarily formed respectively with said left and right ear sections to extend rearwardly and about the back of the head, said left and right securing sections each having fastening means associated therewith at the distal ends thereof to fasten said left and right securing sections together, said left and right securing sections each being formed to have a length extending from an upper edge extending between the top of the ears behind the user's head and a lower edge, said upper edge being sized longer than said lower edge to angulate the said left and right securing sections inwardly to substantially conform to the shape of the head.

* * * * *